US006768505B2

(12) United States Patent
Zelenka

(10) Patent No.: US 6,768,505 B2
(45) Date of Patent: Jul. 27, 2004

(54) METHOD AND APPARATUS FOR EXPOSING PRINTING FORMS

(75) Inventor: Thomas Zelenka, Mönkeberg (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 23 days.

(21) Appl. No.: 10/141,841

(22) Filed: May 9, 2002

(65) Prior Publication Data

US 2002/0167584 A1 Nov. 14, 2002

(30) Foreign Application Priority Data

May 9, 2001 (DE) ..... 101 22 484

(51) Int. Cl.[7] ..... B41J 2/435; B41J 2/47; B41J 2/447; B41J 2/45

(52) U.S. Cl. ..... 347/233; 347/241; 347/243

(58) Field of Search ..... 347/233, 255, 347/239, 256, 241, 259, 234; 201/467, 453, 457, 462, 463.1; 430/302, 330, 945, 964

(56) References Cited

U.S. PATENT DOCUMENTS

| | | | |
|---|---|---|---|
| 525,749 A | * | 6/1894 | Maeda et al. |
| 3,730,620 A | | 5/1973 | Jackson |
| 4,468,706 A | | 8/1984 | Cahill |
| 5,351,617 A | | 10/1994 | Williams et al. |
| 5,912,458 A | | 6/1999 | Squires et al. |
| 5,923,359 A | | 7/1999 | Montgomery |

FOREIGN PATENT DOCUMENTS

| | | |
|---|---|---|
| DE | 30 04 749 A1 | 8/1980 |
| DE | 31 26 642 A1 | 6/1982 |
| EP | 0 207 711 A1 | 1/1987 |
| EP | 0 557 998 A2 | 9/1993 |
| EP | 0 992 350 A1 | 4/2000 |
| GB | 1 557 881 | 12/1979 |
| GB | 2 079 487 A | 1/1982 |
| GB | 2 293 460 A | 3/1996 |
| GB | 2 314 937 A | 1/1998 |
| WO | 96/35144 | 11/1996 |

* cited by examiner

*Primary Examiner*—Huan Tran
(74) *Attorney, Agent, or Firm*—Laurence A. Greenberg; Werner H. Stemer; Gregory L. Mayback

(57) ABSTRACT

A method and an apparatus for exposing photosensitive material, in particular for exposing a printing form, in which a surface to be exposed of the photosensitive material is scanned by at least one light beam. The light beam is emitted by a light source and, before striking the photosensitive material, is optionally modulated, interrupted and/or deflected. An exposure head is provided and moved at a constant distance from the surface in relation to the latter and to the light source in order to scan the surface of the photosensitive material with the light beam. In order to make the exposure head as light as possible, after the light beam has emerged from the light source substantially parallel to the surface to be exposed, the light beam is deflected through a gaseous medium toward the exposure head and there should be reflected onto the surface.

19 Claims, 3 Drawing Sheets

METHOD AND APPARATUS FOR EXPOSING PRINTING FORMS

BACKGROUND OF THE INVENTION

Field of the Invention

The invention relates to the field of electronic reproduction technology and in particular to the direct exposure of printing forms from a digital database, which can be carried out either in an exposer, preferably a flat bed exposer, or directly on a drum of a printing machine. The invention relates in particular to a method and an apparatus for exposing photosensitive material, in particular for exposing a printing form, in which a surface to be exposed of the photosensitive material is scanned by at least one light beam, which is emitted by a light source and, before striking the photosensitive material, is optionally modulated, interrupted and/or deflected, and in which an exposure head is moved at a constant distance from the surface in relation to the latter and to the light source, in order to scan the surface of the photosensitive material with the light beam.

In order to expose printing forms of printing machines, in recent years, in addition to the conventional method of exposure by use of films, exposure methods operating digitally have been used to an increased extent. In the case of these exposure methods, the image information to be transferred to the printing form is supplied in the form of digital signals to an exposure unit. There, the signals are used to drive light sources, in order to switch the light sources on and off or to modulate the intensity of the light beams emitted or in order to interrupt, deflect or modulate the intensity of the light beams emitted by the light sources after they have emerged from the light sources, so that the exposure of each image point or pixel on the printing form corresponds to the image information to be transferred to this point. The scanning of the printing form surface with the light beams is usually carried out by a writing or exposure head, as it is known, which is moved along the surface at a constant distance from the latter and, in the process, deflects the light beams guided to the printing form onto the surface line by line or column by column.

Here, the exposure head may carry the light sources and devices for interrupting, deflecting or modulating the light beams, such as in the case of exposure devices from BasysPrint which, in addition to a UV light source, contain a component that is irradiated with incoherent light from the UV light source and contains a large number of micromirrors. Each of the micromirrors corresponds to one pixel or image point of a raster image produced by the scanning on the printing form and can be driven digitally, in order either to project the incident UV light through an optical system onto the printing form or to deflect the light to such an extent that it is not acquired by the optical system. In addition to the UV light source and the micromirror array, the exposure head of the exposure devices needs a power supply and cooling devices, as a result of which it becomes relatively heavy. In order to move such an exposure head in a meandering fashion over the surface of the printing form, high acceleration forces are needed for acceleration and braking at the start and end of each line, and a great deal of power is consumed.

Furthermore, it is known, for example from U.S. Pat. No. 5,351,617, in a system for exposing printing plates by using digitally controlled laser beams, for the laser beams generated in a plurality of stationary laser light sources and used for the exposure to be led via flexible optical conductors to a moveable exposure head, which is moved along at a constant distance on a flat or cylindrical printing form surface and scans the latter point by point or line by line with laser beams emerging from the optical conductors. However, the exposure head of the system must be equipped between the fiber exit from each optical conductor and the surface of the printing form with a lens system for focusing the laser beams, which, together with the optical conductors and the devices required to couple the laser beams into the optical conductors, contribute not insignificantly to the costs of such a system.

SUMMARY OF THE INVENTION

It is accordingly an object of the invention to provide a method and an apparatus for exposing printing forms which overcome the above-mentioned disadvantages of the prior art methods and devices of this general type, in which an exposure head is configured to be as light as possible, and without the use of optical conductors.

With the foregoing and other objects in view there is provided, in accordance with the invention, a method of exposing a photosensitive material. The method includes the steps of providing a light source emitting a light beam substantially parallel to a surface to be exposed, providing an exposure head and the light beam is deflected through a gaseous medium toward the exposure head and reflected by the exposure head onto the surface to be exposed, and using the light beam to scan the surface of the photosensitive material. The light beam, before striking the photosensitive material, is selectively modulated, interrupted and/or deflected. During the scanning, the exposure head is moved, at a constant distance from the surface, in relationship to the surface and to the light source to scan the surface of the photosensitive material with the light beam.

According to the invention, the object is achieved in that after emerging from the light source substantially parallel to the surface of the photosensitive material, the light beam is deflected through a gaseous medium toward the exposure head and there is reflected onto the surface.

The invention is based on the idea of bridging the varying distance between the moveable exposure head and the light source by use of a light beam guided rectilinearly through the surrounding air, the light beam then being deflected toward the surface of the photosensitive material by a reflector disposed on the exposure head. The parallel alignment of the surface of the photosensitive material and of the light beam before the latter strikes the exposure head ensures that the light beam always strikes the same point on the reflector, irrespective of the position of the exposure head, and therefore when a pulsed light source is used or a plurality of parallel light beams, the distance between two adjacent image points is always constant. The reflector required to deflect the light beam onto the exposure head can be produced with a very low weight, so that high acceleration of the exposure head with low expenditure of force and power is made possible.

According to a preferred refinement of the invention, the alignment of the light beam before it strikes the exposure head preferably corresponds to the direction of the relative movement between the latter and the light source, so that it can be maintained unchanged during the entire exposure time. In the process, the exposure head and the light source are expediently moved alternately toward each other and away from each other in this direction, while the surface of the photosensitive material is scanned line by line by the light beam. In order to scan its surface, the photosensitive material is preferably moved in relation to the exposure head in a direction that is perpendicular to the direction of the relative movement between the exposure head and the light source.

A further preferred refinement of the invention provides for the light source to be formed by a laser diode belonging to a line of laser diodes. The line of laser diodes emits a plurality of parallel laser beams which, after passing through an optical system in order to collimate the laser beams and/or in order to reduce the beam diameter and the spacing of the laser beams parallel to the surface of the photosensitive material, are deflected toward the exposure head through the air between the optical system and the exposure head and there are reflected toward the surface in a parallel alignment.

The method according to the invention is preferably used for the exposure of printing forms with laser light in a flat bed exposer or on a drum of a printing machine. In the first-named case, the exposure head is expediently moved to and fro rectilinearly over the surface of the printing form, while it is supplied with a plurality of parallel laser beams from a plurality of laser diodes. The laser diodes are expediently disposed to be stationary on the other side of one circumferential edge of the printing form, while the printing form, together with a support table for the exposer is displaced under the exposure head in a direction perpendicular to the direction of movement of the exposure head.

In the last-named case, the printing form clamped onto the surface of the drum, together with the drum, is set rotating, while the exposure head is moved in the axial direction along the drum and the printing form in order to scan the printing form surface. In this case, a plurality of parallel laser beams parallel to the axis of rotation of the drum from the light sources disposed on the other side of one end of the printing form is deflected toward the exposure head, and the surface of the printing form is scanned, preferably in the drum circumferential direction. The rotational speed of the drum is expediently chosen such that, during one revolution of the drum, the exposure head is displaced axially by the width of one or more lines running in the circumferential direction.

The movement of the printing form in relation to the exposure head and to the light sources, which in the case of the flat bed exposer is carried out at right angles to the to and fro movement of the exposure head or, respectively, the movement of the exposure head along the drum surface, can be carried out step by step in steps of one or more line widths or continuously, where in the last-named case, the information transmitted by a laser beam must correspond to the desired information on a meandering or helical line inclined with respect to the direction of the movement.

In accordance with an added mode of the invention, there is the step of moving the photosensitive material and the light source is kept stationary.

In accordance with an additional mode of the invention, there is the step of clamping the photosensitive material onto a plane and the exposure head is moved in a meandering fashion over the plane.

In accordance with another mode of the invention, there is the step of clamping the photosensitive material on a drum and the light beam is deflected toward the exposure head in an axial direction of the drum.

In accordance with a further mode of the invention, there is the step of scanning the surface of the photosensitive material by a plurality of light beams. The light beams are deflected parallel to one another through the gaseous medium toward the exposure head and are provided by a plurality of light sources.

In accordance with a concomitant mode of the invention, there is the step of reducing a spacing and a diameter of the light beams between the light sources and the exposure head.

With the foregoing and other objects in view there is provided, in accordance with the invention, an apparatus for exposing a photosensitive material. The apparatus contains devices used for scanning a surface to be exposed of the photosensitive material with at least one light beam. The devices include a light source emitting the light beam, and a unit for selective modulation, interruption and/or deflection of the light beam. The unit is disposed downstream of the light source. An exposure head is provided and is movable at a constant distance from the surface in relation to the surface and to the light source for scanning the surface of the photosensitive material with the light beam. The light beam is received by the exposure head, and over at least one part of a distance between the light source and the exposure head, the light beam passes through a gaseous medium substantially parallel to the surface to be exposed. The exposure head contains a reflector for reflecting the light beam onto the surface, and the exposure head is disposed downstream of the unit.

In accordance with an added feature of the invention, a flat support table is provided for carrying the photosensitive material, and the exposure head can be moved in a meandering fashion over the support table.

In accordance with an additional feature of the invention, a drum is provided and the photosensitive material is clamped on the drum. Along the drum, the exposure head is moved in an axial direction and the photosensitive material can be acted on by the light beam in the axial direction.

In accordance with another feature of the invention, the light source is one of a plurality of light sources producing a plurality of parallel light beams for a simultaneous scanning of the photosensitive material. An optical system is disposed between the plurality of light sources and the exposure head. The optical system reduces a spacing and a diameter of the parallel light beams between the light sources and the exposure head. The optical system images the parallel light beams from the plurality of light sources telecentrically on the photosensitive material.

In accordance with a concomitant feature of the invention, the unit is one of a plurality of units for selective modulation, interruption and/or deflection of the light beam. The units produce a plurality of parallel light beams for a simultaneous scanning of the photosensitive material. An optical system is disposed between the units and the exposure head. The optical system images the parallel light beams from the units telecentrically on the photosensitive material.

Other features which are considered as characteristic for the invention are set forth in the appended claims.

Although the invention is illustrated and described herein as embodied in a method and an apparatus for exposing printing forms, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
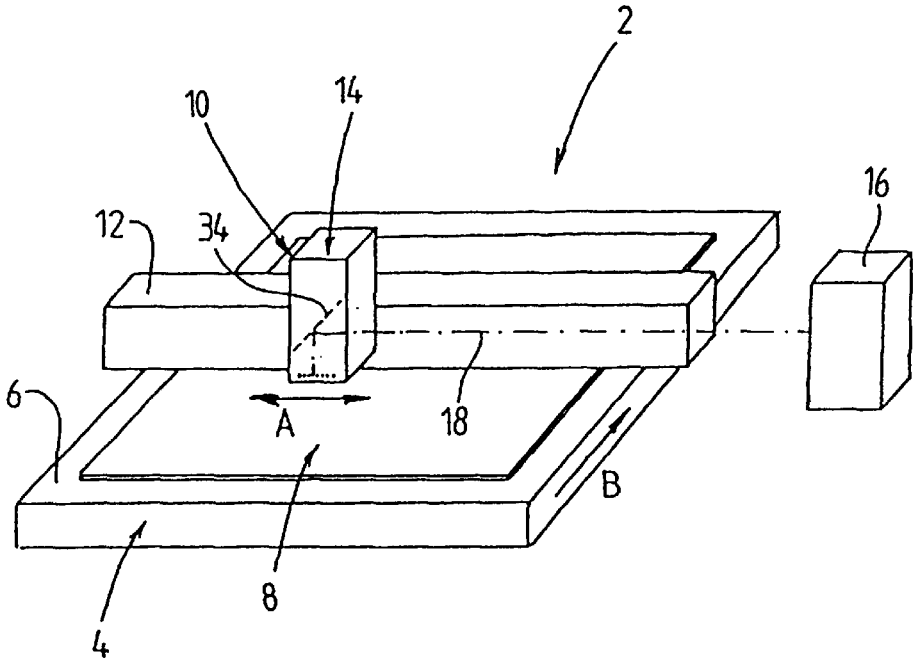
FIG. 1 is a diagrammatic, perspective view of an exposure apparatus for exposing a printing form on a flat support table according to the invention.

Referring now to the figures of the drawing in detail and first, particularly, to FIG. 1 thereof, there is shown a flat bed exposer 2 for printing forms. The bed exposer 2 substantially contains a support table 4 with a flat support surface 6 for a printing form 8 to be exposed, and an exposure device 10 which can be moved in relation to the support table 4 and the printing form 8 clamped thereon.

The exposure device 10 substantially contains a guide 12 running transversely over the support table 4 at a constant distance from the support surface 6, an exposure head 14 that can be displaced to and fro in a direction of a double-headed arrow A along the guide 12 by a motor, and a stationary housing 16 which is disposed on one side of the support table 4 and which accommodates a plurality of light sources 20 (FIG. 2), from which a laser light is emitted toward the exposure head 14 along an optical axis 18 that is parallel to the guide 12.

Figure 2:
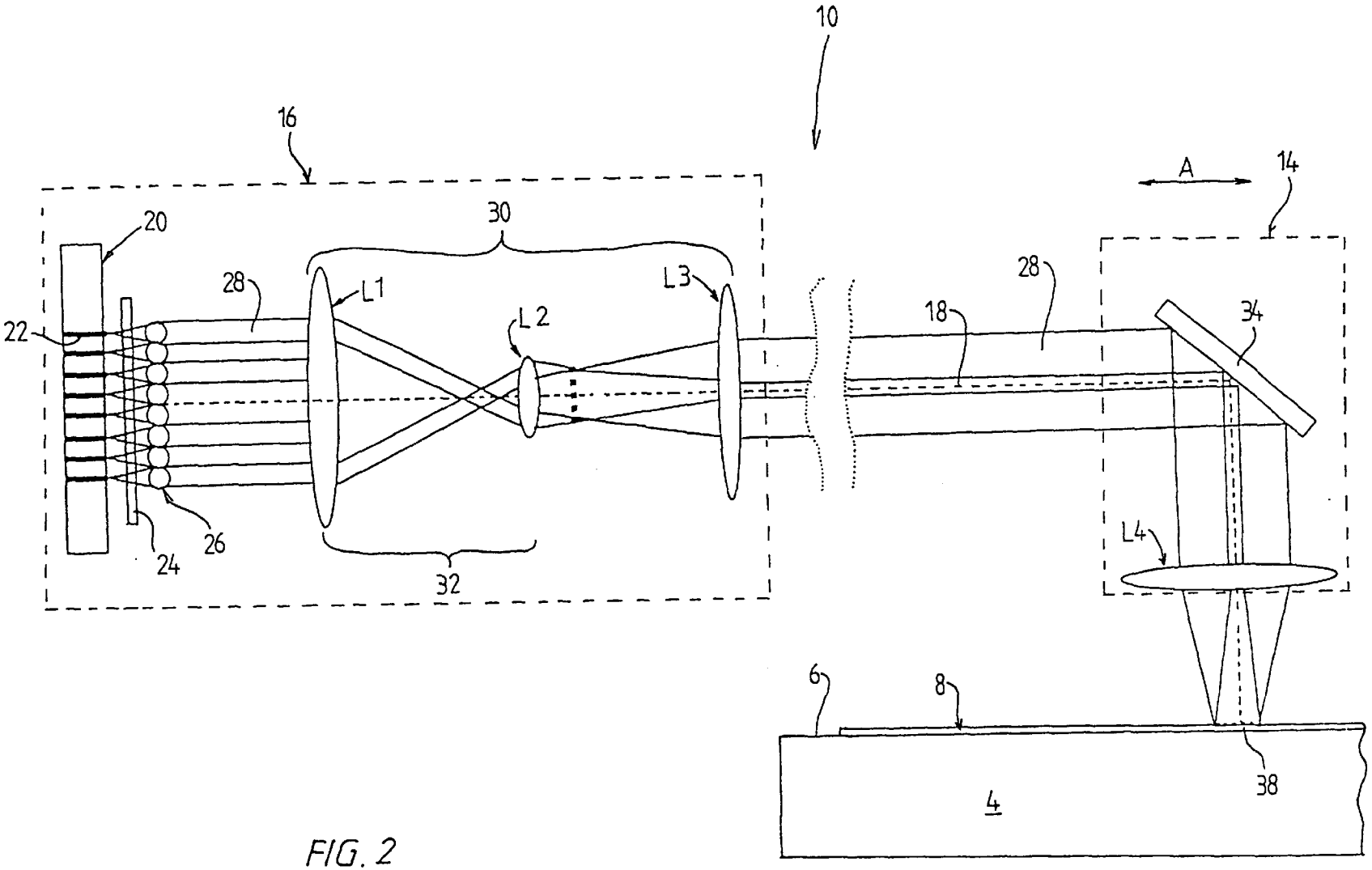
FIG. 2 is an illustration of a beam path in the exposure apparatus from a plurality of light sources via an optical system and an exposure head to the printing form clamped on the support table.

As best illustrated in FIG. 2, the light sources are formed by a linear laser diode array 20 containing a plurality of laser diodes 22 disposed beside one another, which are intensity modulated in accordance with an item of image information to be transferred. A coherent laser light emitted by each laser diode 22 is shaped into a laser beam 28 by a cylindrical lens 24 and a lens array 26 used to collimate the laser light and disposed in the housing 16 in the vicinity of the laser diode array 20. After emerging from the lens array 26, the laser beams 28 aligned parallel to one another enter a telecentric optical system 30, in which the spacing between the laser beams 28 and their diameter is reduced, for example by a factor 20. The optical system 30 shown in FIG. 2 contains two convex lenses L1 and L2, which together form a telescope 32 for this purpose.

After passing through a collimator lens L3, the laser beams 28 emerge from the housing 16 along the optical axis 18 and, after bridging the relatively large air gap between the housing 16 and the exposure head 14, strike a flat mirror 34 which is fitted to the exposure head 14 and inclined at an angle of 45 degrees with respect to the optical axis 18. At the mirror 34, or at a prism serving as a reflector in the place of the mirror 34, the laser beams 28 are deflected through 90 degrees and are reflected downward onto the surface of the printing form 8, perpendicular to the guide 12. The exposure head 14 also bears a lens L4 that is disposed underneath the mirror 34, between the mirror 34 and the support table 4 and which is used to focus the laser beams 28 on the printing form surface. However, since the exposure head 14 neither bears a light source nor is connected to a light source via optical conductors, it is very robust and light in weight which, together with a relatively low expenditure of force and power, permit high positive and negative acceleration at the start and end of its to and fro movement.

In order to scan the entire surface of the printing form 8 line by line with the laser beams 28 reflected from the mirror 34, the support table 4 together with the printing form 8 is preferably moved perpendicular to the direction of movement A of the exposure head 14 by a non-illustrated motor drive, for example in the direction of the arrow B in FIG. 1, in order to feed the printing form 8 in this direction under the guide 12 and the exposure head 14 moved to and fro and, in the process, to expose it. The exposure is preferably carried out during the entire to and fro movement of the exposure head 14 which, in the process, moves in a meandering fashion over the printing form 8.

Instead of moving the support table 4 and the printing form 8 past the stationary housing 16 in the direction of the arrow B, it is of course also possible to keep the support table 4 with the printing form 8 stationary and to move the housing 16, as a unit with the guide 12, in the direction of the arrow B or in the opposite direction in relation to the support table 4.

In addition to the laser diode array 20 illustrated in FIG. 2, the exposure device 10 can contain further non-illustrated linear laser diode arrays, whose laser beams are coupled out of the laser diode array 20 into the beam path of the laser beams 28 parallel to the optical axis 18, in order to increase a number of image points 38 of a line on the printing form 8 which are exposed simultaneously or to expose image points 38 simultaneously in a plurality of lines by using a two-dimensional array of laser beams 28. The input coupling is preferably carried out between the lens array 26 and the lens L1, in order to keep the number of components of the exposure device 10 as low as possible, but can also be carried out at another point. Instead of one or more linear laser diode arrays 20, it is of course also possible for one or more two-dimensional laser diode arrays to be used.

Figure 3:
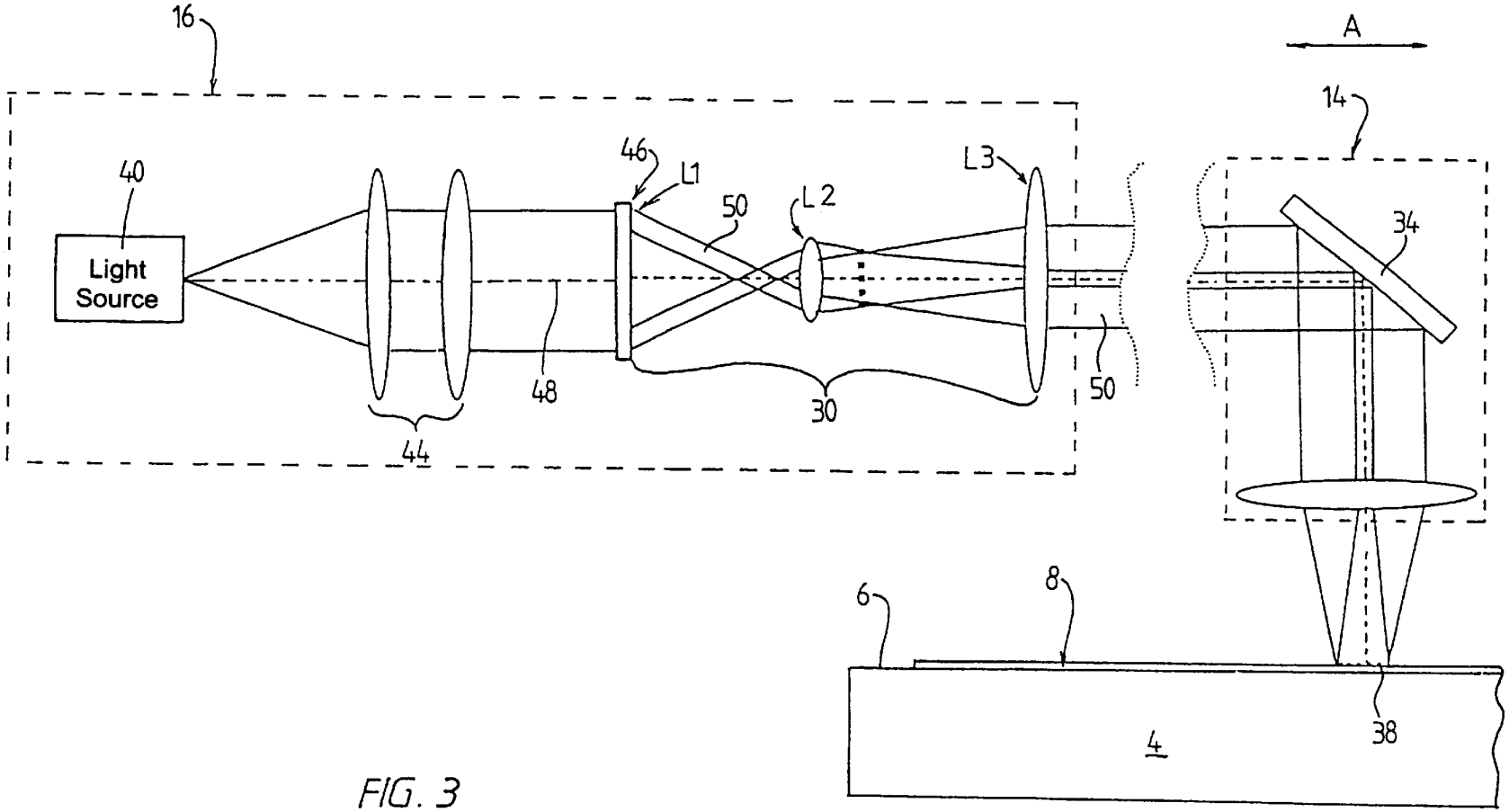
FIG. 3 is an illustration corresponding to FIG. 2, but in the case of using a single light source and an optical switch array between the light source and the exposure head.

As distinct from the exposure device 10 described previously, the housing 16 in the exposure device 10 illustrated in FIG. 3 encloses only a single laser light source 40, for example a pulsed laser, which emits pulsed laser light with a constant light intensity. The laser light emerging from the laser 40 is deflected uniformly onto a two-dimensional array 46 of microoptical switches by illumination optics 44 disposed behind the laser 40, the microoptical switches 46 modulate the incident laser light in accordance with the item of image information respectively to be transferred. The optical switch array 46 contains a two-dimensional regular configuration of cells which are aligned perpendicularly to an optical axis 48 of the laser light and in which, in a known way, liquid or ferroelectric crystals are respectively disposed between two electrodes. When the crystals are subjected to an electrical field as a result of a voltage being applied to the electrodes, the polarization of the laser light passing through is changed, which is converted by an integrated polarizer into a change in the light intensity.

In order to image the microoptical switches of the optical switch array 46 telecentrically on the printing form 8, the telecentric optical system 30 is disposed in the housing 16, in the beam path behind the optical switch array 46, as in the exposure device 10 in FIG. 2. After passing through the collimator lens L3 of the optical system 30, the laser beams 50 are deflected parallel to the surface of the printing form 8 toward the exposure head 14 and there are reflected and focused perpendicularly onto the surface of the printing form 8.

Instead of selective light interruption in the optical switch array 46 in accordance with the image information to be transferred, selective light deflection can also be performed, for example with the aid of acousto-optical modulators or a non-illustrated micromirror array such as is used, for example, in flat bed exposers from BasysPrint. A micromirror array of this type contains a plurality of moveable micromirrors, which are illuminated uniformly with the laser light from the laser light source 40 via the illumination optics 44 and are driven digitally in accordance with the image information to be transferred, in order to deflect the incident laser light in the form of laser beams optionally toward the exposure head 14 via imaging optics corresponding to the optical system 30 or to mask it out.

In order to simplify the illustration, in FIGS. 2 and 3, only the beam path of two marginal laser beams 28, 50 are illustrated behind the lens L1 and respectively, behind the optical switch array 46.

Figure 4:
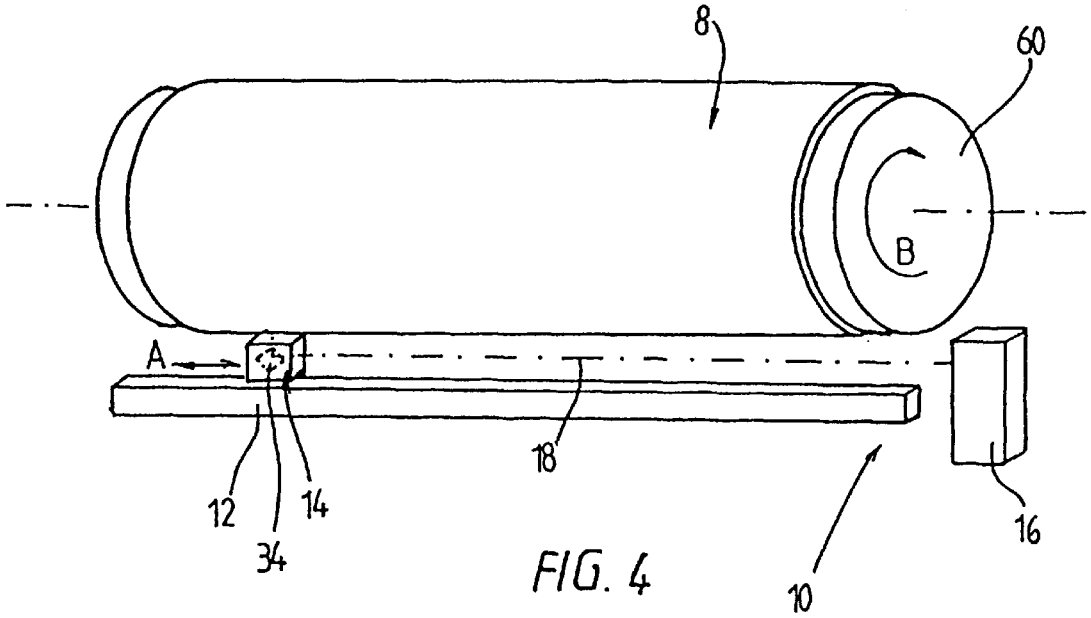
FIG. 4 is a perspective view of another exposure apparatus according to the invention for exposing the printing form on a drum of a printing machine.

In the case of the exposure, illustrated in FIG. 4, of the printing form 8 clamped onto a drum 60 of a printing machine, the housing 16 of the exposure device 10 having one or more laser light sources and an optical system corresponding to the left-hand part of FIG. 2 or 3 is disposed to be stationary in the vicinity of one end of the drum 60, while the exposure head 14 is moved along the printing form 8 in the axial direction of the drum 60 and along the optical axis 18 of the parallel laser beams emerging from the housing 16. The printing form 8 turns together with the drum 60 at high speed, their surface being scanned on a helical path by the laser beams. The axial movement of the exposure head 14 is carried out more slowly here than the meandering movement of the exposure head 14 in the flat bed exposer 2 in FIG. 1.

I claim:

1. A method of exposing a photosensitive material, which comprises the steps of:

providing a a plurality of light sources emitting a plurality of light beams substantially parallel to a surface to be exposed;

providing an exposure head, the light beams being deflected parallel to one another through a gaseous medium toward the exposure head and reflected by the exposure head onto the surface to be exposed;

using the light beams to scan the surface of the photosensitive material, the light beams, before striking the photosensitive material, being at least one of selectively modulated, interrupted and deflected, and during scanning, moving the exposure head, at a constant distance from the surface, in relationship to the surface and to the light sources to scan the surface of the photosensitive material with the light beams; and reducing a spacing and a diameter of the light beams between the light sources and the exposure head.

2. The method according to claim 1, which comprises moving the exposure head and the light sources alternately toward each other and away from each other in a given direction.

3. The method according to claim 2, which comprises moving the photosensitive material in relation to the exposure head and to the light sources in a further direction that is perpendicular to the given direction.

4. The method according to claim 1, which comprises moving the photosensitive material and the light sources are kept stationary.

5. The method according to claim 1, which comprises clamping the photosensitive material onto a plane and the exposure head is moved in a meandering fashion over the plane.

6. The method according to claim 1, which comprises clamping the photosensitive material on a drum and the light beams are deflected toward the exposure head in an axial direction of the drum.

7. The method according to claim 1, which comprises using a laser light sources for emitting the light beams.

8. The method according to claim 1, which comprises using a printing form as the photosensitive material to be exposed.

9. An apparatus for exposing a photosensitive material, the apparatus comprising:

devices used for scanning a surface to be exposed of the photosensitive material with a plurality of parallel light beams, said devices including:

a plurality of light sources emitting the light beams;

at least one unit for at least one of selective modulation, interruption and deflection of the light beams, said unit disposed downstream of said light sources;

an exposure head movable at a constant distance from the surface in relation to the surface and to said light sources for scanning the surface of the photosensitive material with the light beams, the light beams being received by said exposure head and over at least one part of a distance between said light sources and said exposure head, the light beams pass through a gaseous medium substantially parallel to the surface to be exposed, said exposure head containing a reflector for reflecting the light beams onto the surface, said exposure head disposed downstream of said at least one unit; and an optical system disposed between said plurality of light sources and said exposure head, said optical system reducing a spacing and a diameter of the parallel light beams between said light sources and said exposure head.

10. The apparatus according to claim 9, wherein said exposure head and said light sources move alternately toward each other and away from each other in a given direction.

11. The apparatus according to claim 10, wherein the photosensitive material moves in relation to said exposure head and to said light sources in a further direction that is perpendicular to the given direction.

12. The apparatus according to claim 9, wherein said light sources are stationary and the photosensitive material can be moved in relation to said light sources.

13. The apparatus according to claim 9, further comprising a flat support table for carrying the photosensitive material, and said exposure head can be moved in a meandering fashion over said support table.

14. The apparatus according to claim 9, further comprising a drum and the photosensitive material is clamped on said drum, and along said drum said exposure head is moved in an axial direction and the photosensitive material can be acted on by the light beams in the axial direction.

15. The apparatus according to claim 9, wherein said light sources are lasers.

16. The apparatus according to claim 9, wherein said optical system images the parallel light beams from said plurality of light sources telecentrically on the photosensitive material.

17. The apparatus according to claim 9, wherein said at least one unit produces the plurality of parallel light beams for a simultaneous scanning of the photosensitive material.

18. The apparatus according to claim 17, further comprising an optical system disposed between said at least one unit and said exposure head, said optical system imaging the parallel light beams from said unit telecentrically on the photosensitive material.

19. The apparatus according to claim 9, wherein the photosensitive material is a printing form.

* * * * *